US006959629B2

(12) United States Patent
Hsien

(10) Patent No.: US 6,959,629 B2
(45) Date of Patent: Nov. 1, 2005

(54) HAND TOOL HAVING A RETRACTABLE HANDLE STRUCTURE

(76) Inventor: Chih-Ching Hsien, 58, Ma Yuan West St., Taichung (TW)

( * ) Notice: Subject to any disclaimer, the term of this patent is extended or adjusted under 35 U.S.C. 154(b) by 0 days.

(21) Appl. No.: 10/643,480

(22) Filed: Aug. 15, 2003

(65) Prior Publication Data

US 2005/0034573 A1 Feb. 17, 2005

(51) Int. Cl.[7] ..... B25G 1/04

(52) U.S. Cl. ..... 81/177.2; 81/489; 403/109.3; 403/109.5

(58) Field of Search ..... 81/177.2, 177.1, 81/427.5, 439, 489, 177.85; 403/107, 108, 109.2, 109.3, 109.5, 109.1; 430/109.1

(56) References Cited

U.S. PATENT DOCUMENTS

| | | | | | |
|---|---|---|---|---|---|
| 1,284,351 | A | * | 11/1918 | Jagielo | 81/427.5 |
| 1,431,805 | A | * | 10/1922 | Hrenczuk | 81/177.2 |
| 2,893,765 | A | * | 7/1959 | Lyon | 403/107 |
| 4,376,397 | A | * | 3/1983 | Newby et al. | 81/177.2 |
| 4,409,866 | A | * | 10/1983 | McBride | 81/177.2 |
| 5,471,899 | A | * | 12/1995 | Twomlow | 81/177.2 |
| 6,666,114 | B1 | * | 12/2003 | Lin | 81/438 |

* cited by examiner

*Primary Examiner*—Hadi Shakeri

(57) ABSTRACT

A hand tool includes a retractable shank, a handle, an elastic member, and at least one fixing pin. Thus the rod assembly of the retractable shank can be retracted into and expanded outward from the receiving chamber of the handle so as to adjust the distance between the retractable shank and the handle, so that the working length of the hand tool can be can be easily, rapidly and arbitrarily.

10 Claims, 8 Drawing Sheets

HAND TOOL HAVING A RETRACTABLE HANDLE STRUCTURE

BACKGROUND OF THE INVENTION

1. Field of the Invention

The present invention relates to a handle tool, and more particularly to a handle tool having a retractable handle structure.

2. Description of the Related Art

A conventional handle tool, such as the wrench, screwdriver, socket or the like, usually comprises a handle and a driving portion mounted on one end of the handle. However, the handle has a fixed length, so that the working length of the conventional handle tool is fixed and cannot be adjusted, thereby limiting the versatility of the conventional hand tool.

SUMMARY OF THE INVENTION

The primary objective of the present invention is to provide a handle tool having a retractable handle structure.

Another objective of the present invention is to provide a handle tool, wherein the rod assembly of the retractable shank can be retracted into and expanded outward from the receiving chamber of the handle, so as to adjust the distance between the retractable shank and the handle, so that the working length of the handle tool can be adjusted easily, rapidly and arbitrarily.

A further objective of the present invention is to provide a handle tool, wherein each of the limiting grooves of the rod assembly of the retractable shank has a wall formed with a positioning recess for positioning the fixing pin by the restoring force of the elastic member, so that the rod assembly of the retractable shank is fixed a the handle rigidly and stably.

In accordance with the present invention, there is provided a handle tool comprising:

a retractable shank including a rod assembly having an outer wall formed with a longitudially arranged sideway and a plurality of transversally arranged limiting grooves intersecting the sideways;

a handle telescopically mounted on the retractable shank; and at least one fixing pin extended through the handle and having a distal end slidably mounted In the slideway of the rod assembly of the retractable shank and slidably positioned in either one of the limit grooves of the rod assembly of the retractable shank.

Further benefits and advantages of the present invention will become apparent after a careful reading of the details description with appropriate reference to the accompanying drawings.

DETAIL DESCRIPTION OF THE DRAWING

Figure 1:
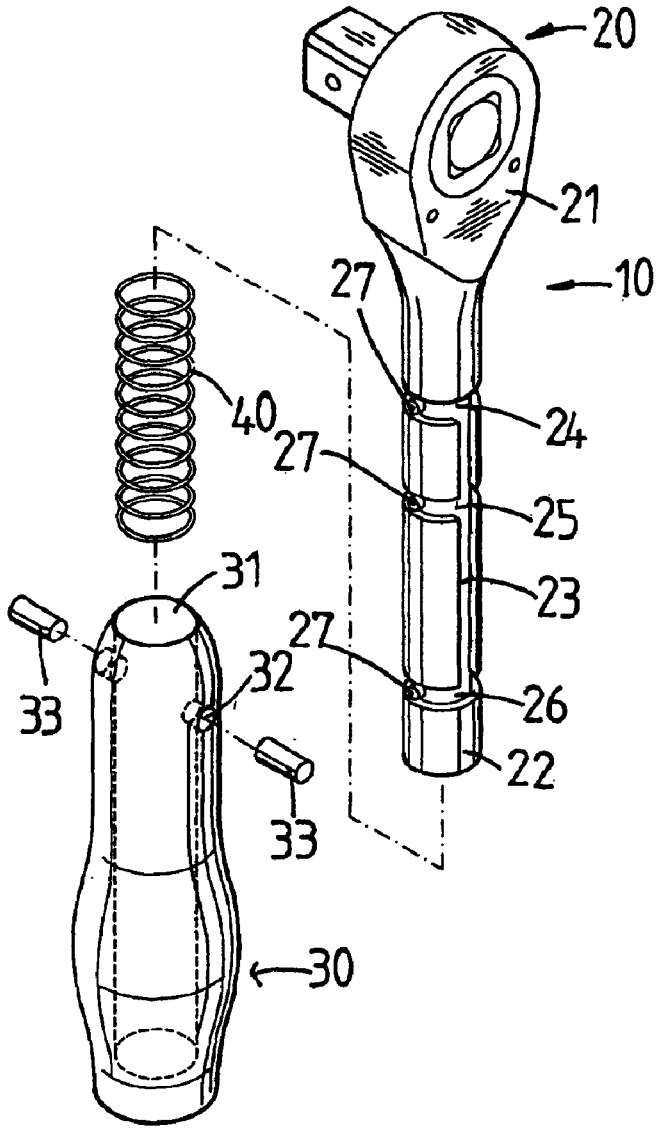
FIG. 1 is an exploded perspective view of the handle tool in accordance with the preferred embodiment of the present invention.
Figure 2:
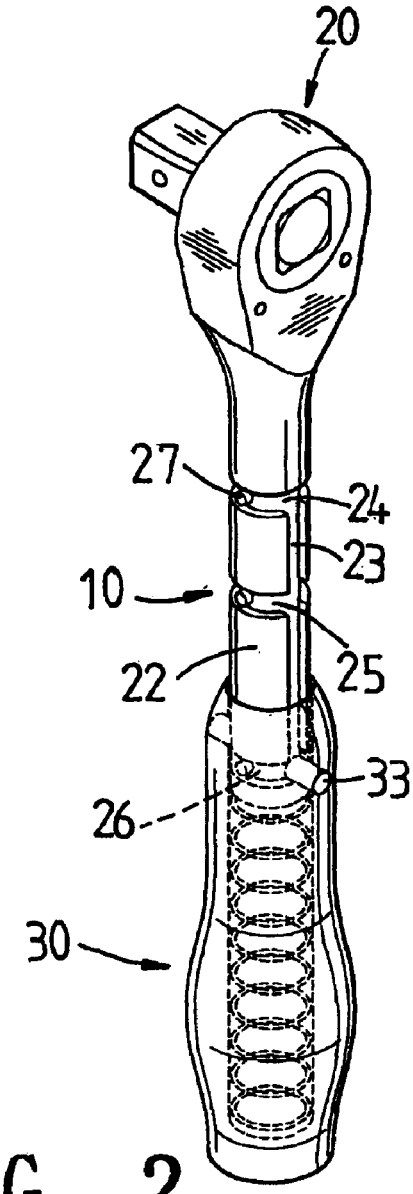
FIG. 2 is a perspective assembled view of the handle tool as shown in FIG. 1.

Referring to drawings and initially to FIGS. 1 and 2, it handle tool 10 in accordance with the preferred embodiment of the present invention comprises a retractable shank 20, a handle 30 telescopically mounted on the retractable shank 20 and an elastic member 40 (such as a spring) mounted between the retractable shank 20 and the handle 30.

The retractable shank 20 includes a rod assembly 22 and a driving portion 21 mounted on one end of the rod assembly 22. The rod assembly 22 of the retractable shank 20 has an outer wall formed with two axially arranged opposite sideway 23, a second transversally arranged limiting groove 24 Intersecting the sideway 23, a second radial circumferential arranged limiting groove 25 intersecting the sideways 23, and a third transversally arranged limiting groove 26 Intersecting the sideway 23. Preferably, the three limiting grooves 24, 25, and 26 are In parallel with each other. In addition, each of the three limiting grooves 24, 25 and 26 has an end provided with a protruding stop portion 27. In the present invention, the sideway is a recess and each groove is a whole circle enclosing a periphery of the retractable shank.

The handle 30 has an inside formed with a receiving chamber 31 for receiving the rod assembly 22 of the retractable shank 20 and the elastic member 40.

The handle tool 10 further comprises two fixing pins 33 each extended through the handle 30 and each having a distal end slidably mounted in the respective sideway 23 of the rod assembly 22 of the retractable shank 20 and slidably positioned in either one of the three limiting grooves 24, 25 and 26. Preferably, the distal end of each of the two fixing pins 33 is extended into the receiving chamber 31 of the handle 30. In addition, the distal end of each of the two fixing pins 33 is stopped by the stop portion 27 of either one of the three limiting grooves 24, 25 and 26 of the rod assembly 22 of the retractable shank 20.

The handle 30 has a periphery formed with two opposite through holes 32 for receiving the two fixing pins 33. Preferably, each of two opposite through holes 32 of the handle 30 communicates with the receiving chamber 31 of the handle 30.

In operation, referring to FIGS. 3–9 with reference to FIGS. 1 and 2, each of the two fixing pins 33 is initially received in the third limiting groove 26 of the rod assembly 22 of the retractable shank 20.

Figure 5:
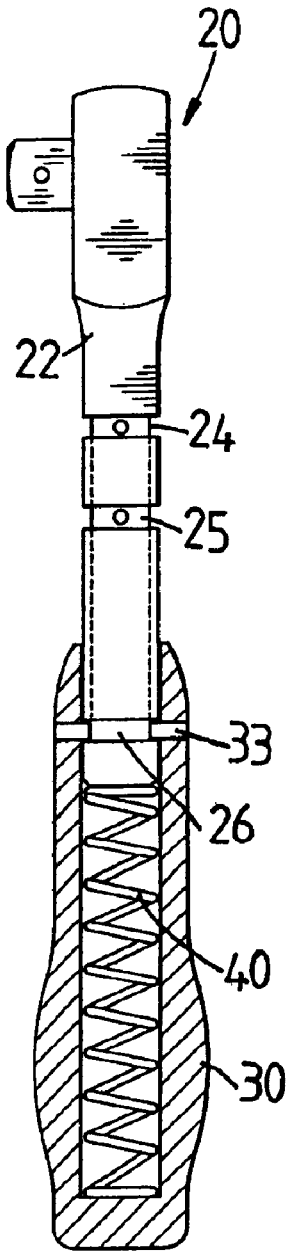
FIG. 5 is a plan cross-sectional view of the handle tool as shown in FIG. 2.

Then, the handle 30 is rotated relative to the rod assembly 22 of the retractable shank 20, so that each of the two fixing pins 33 is moved in the third limiting groove 26 of the rod assembly 22 of the retractable shank 20 to the position as shown in FIGS. 2 and 5, where each of the two fixing pins 33 is aligned with the respective sideway 23 of the rod assembly 22 of the retractable shank 20.

Figure 3:
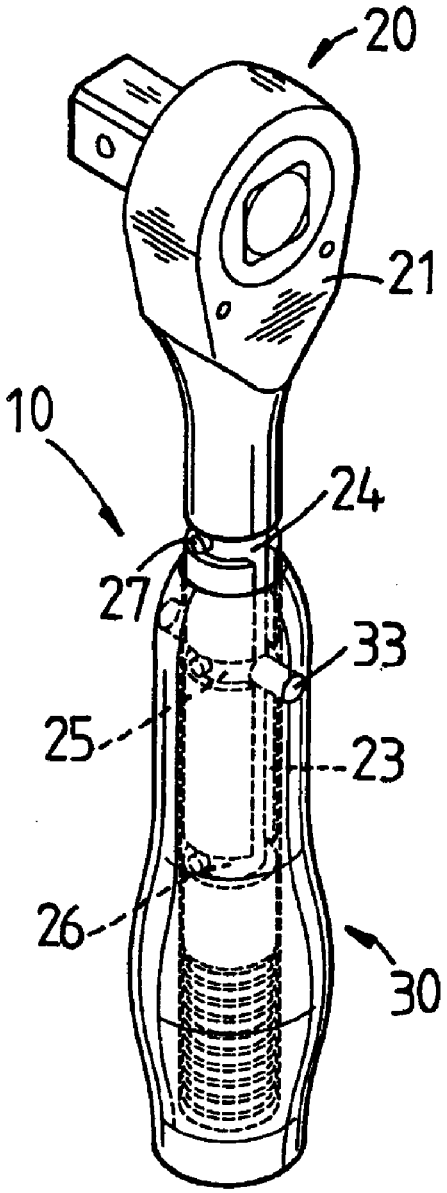
FIG. 3 is a schematic operational view of the handle tool as shown in FIG. 2.
Figure 7:
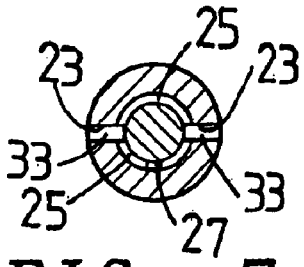
FIG. 7 Is a cross-sectional view of the handle tool taken along line 7—7 as shown in FIG. 6.
Figure 6:
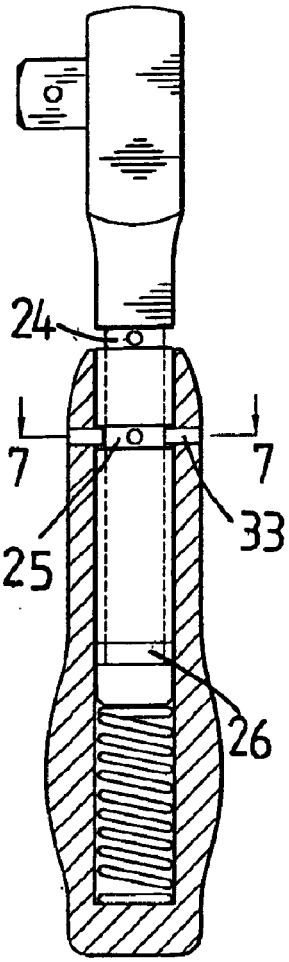
FIG. 6 is a plane cross-sectional view of the handle tool as shown in FIG. 3.

Then, the rod assembly 22 of the retractable shank 20 is pressed to be retracted into the receiving chamber 31 of the handle 30, so that each of the two fixing pins 33 is moved in the respective sideway 23 of the rod assembly 22 of the retractable shank 20 from the position as shown in FIG. 2 to the position as shown in FIGS. 3, 6, and 7, where each of the two fixing pins 33 is aligned with the second limiting groove 25 of the rod assembly 22 of the retractable shank 20.

Figure 4:
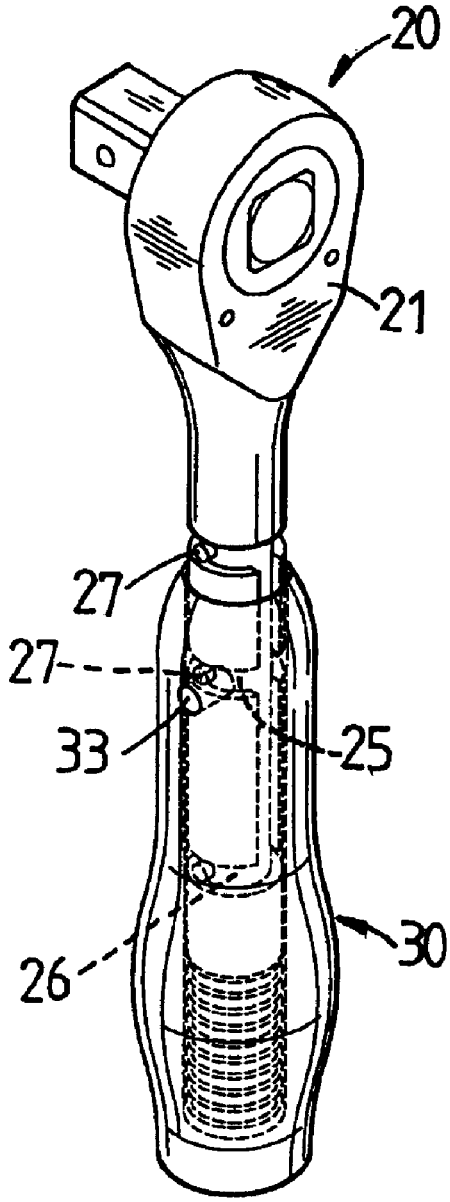
FIG. 4 is a schematic operational view of the handle tool as shown in FIG. 3.
Figure 9:
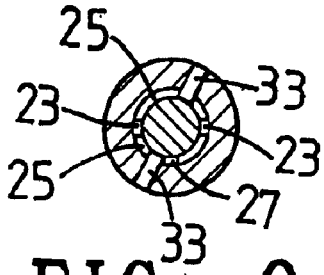
FIG. 9 is a cross-sectional view of the handle tool taken along line 9—9 as shown in FIG. 8.
Figure 8:
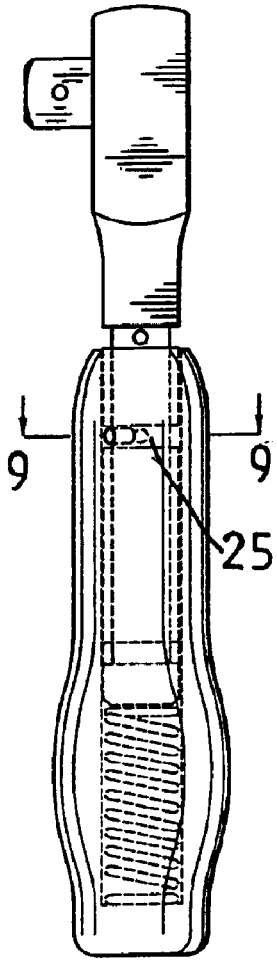
FIG. 8 is a plan cross-sectional view of the handle tool taken along line 9—9 as shown in FIG. 4.

Then, the handle 30 is rotated relative to the rod assembly 22 of the retractable shank 20, so that each of the two fixing pins 33 is moved into the second limiting groove 25 of the rod assembly 22 of the retractable shank 20 and is stopped by the stop portion 27 of the second limiting groove 25 of the rod assembly 22 of the retractable shank 20 as shown in FIGS. 4, 8 and 9.

Thus, the rod assembly 22 of the retractable shank 20 can be retracted into and expanded outward from the receiving chamber 31 of the handle 30, so as to adjust the distance between the retractable shank 20 and the handle 30, so that the working length of the handle tool 10 can be adjusted easily, rapidly and arbitrarily.

Figure 10:
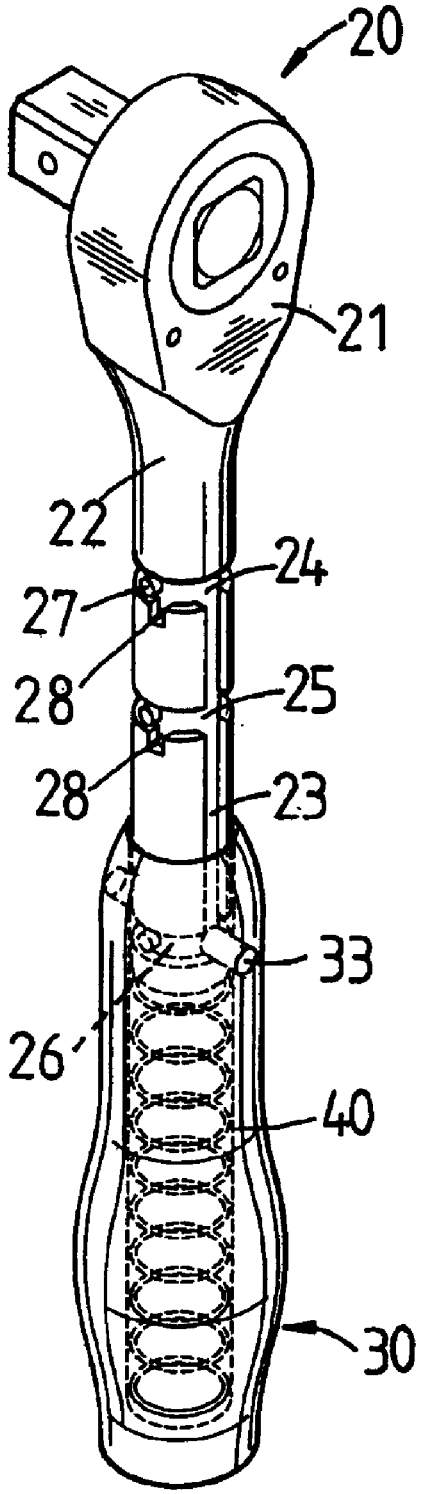
FIG. 10 is a perspective view of a handle tool in accordance with another embodiment of the present invention.
Figure 11:
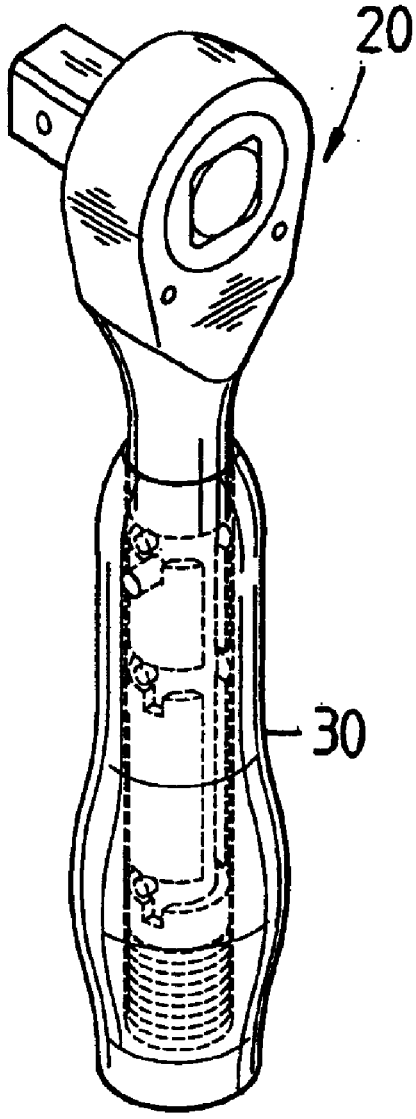
FIG. 11 is a schematic operational view of the handle tool as shown in FIG. 10.

Referring to FIGS. 10 and 11, in accordance with another embodiment of the present invention, each of the three limiting grooves 24, 25 and 26 of the rod assembly 22 of the retractable shank 20 has a wall formed with a positioning recess 28 extended downward fro positioning the fixing pin 33 by the restoring force of the elastic member 40. Preferably, the positioning recess 28 is located adjacent to the stop portion 27.

Figure 12:
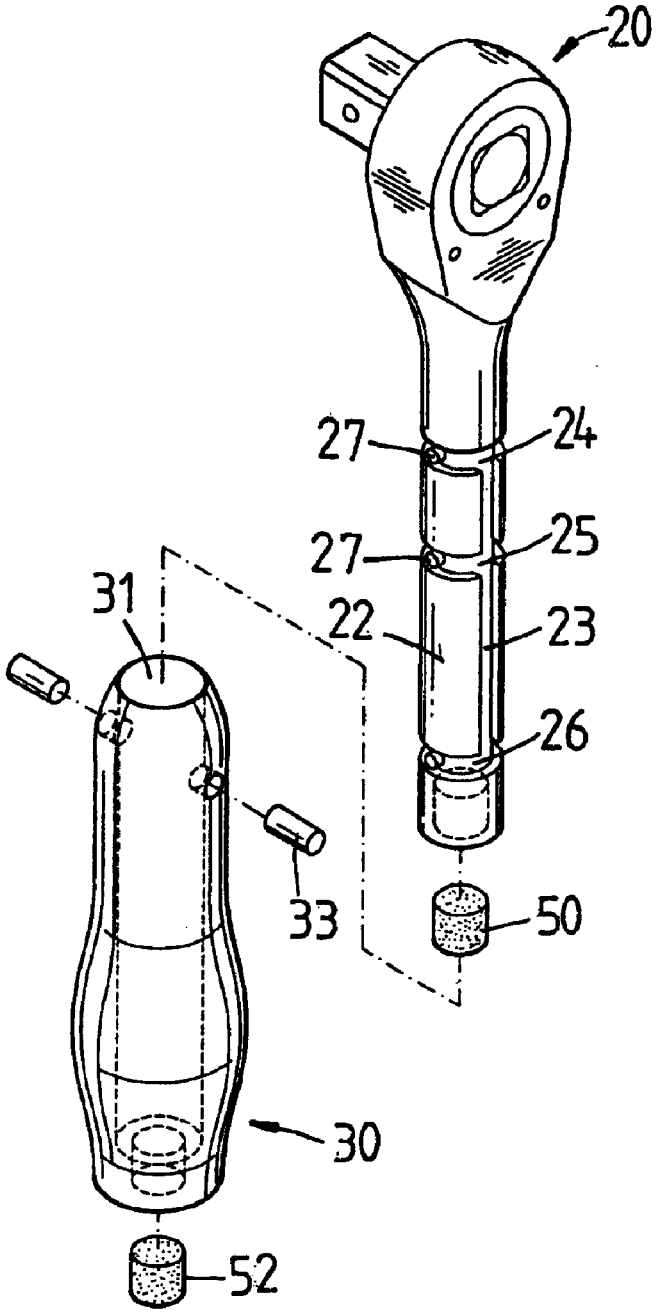
FIG. 12 is an exploded perspective view of a handle tool in accordance with another embodiment of the present invention.
Figure 13:
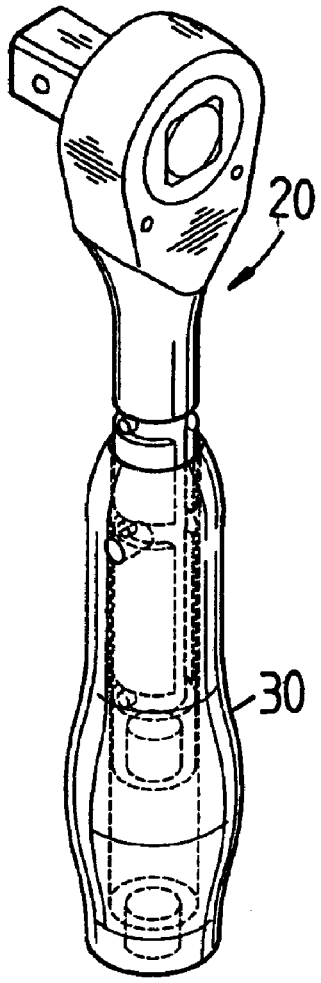
FIG. 13 is a perspective assembled view of the handle tool as shown in FIG. 12.

Referring to FIGS. 12 and 13, in accordance with another embodiment of the present invention, the elastic member 40 is undefined, and the handle tool 10 further comprises a first magnetic member 50 mounted on a distal end of the rod assembly 22 of the retractable shank 20, and a second magnetic member 50 mounted on a bottom of the handle 30 and having a polarity the same as that of the first magnetic member 50, so that the second magnetic member 50 is repulsive with the second magnetic member 50.

Figure 14:
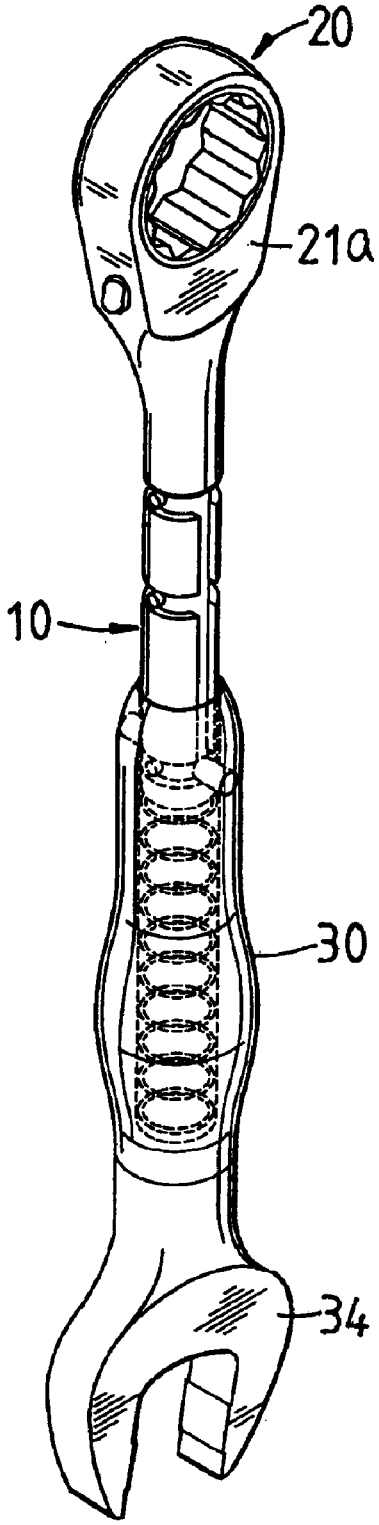
FIG. 14 is a perspective view of a handle tool in accordance with another embodiment of the present invention.

Referring to FIG. 14, in accordance with another embodiment of the present invention, the driving portion 21*a* of the retractable shank 20 is a ratchet wrench, and the handle 30 has an end provided with a driving portion 34.

Figure 15:
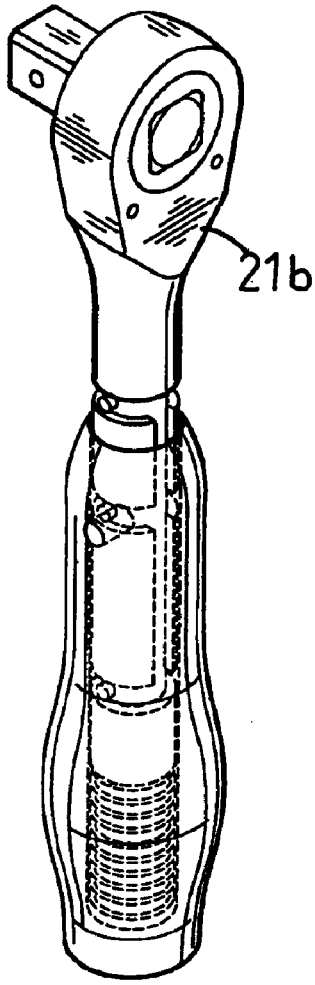
FIG. 15 is a perspective view of a handle tool in accordance with another embodiment of the present invention.

Referring to FIG. 15, in accordance with another embodiment of the present invention, the driving portion 21*b* of the retractable shank 20 is a socket wrench.

Figure 16:
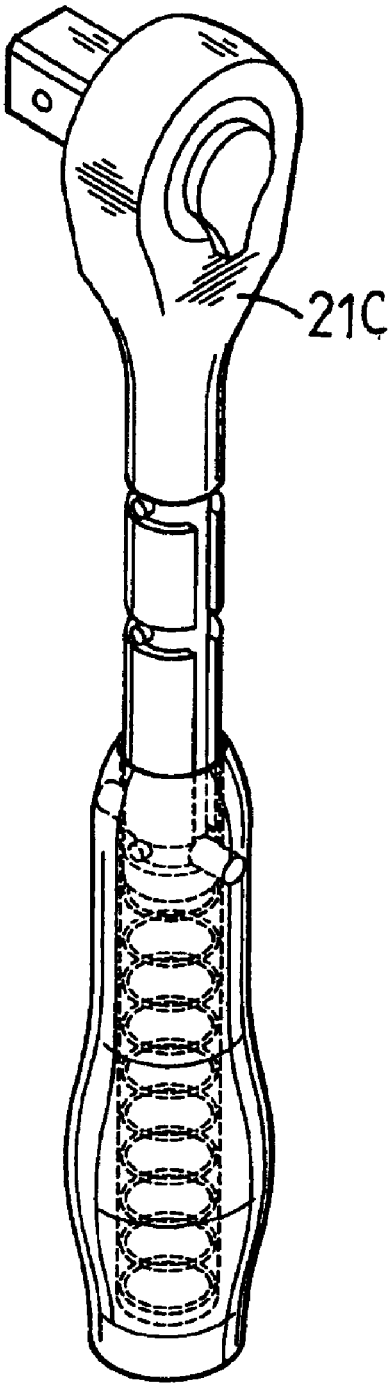
FIG. 16 is a perspective view of a handle tool accordance with another embodiment of the present invention.

Referring to FIG. 16, in accordance with another embodiment of the present invention, the driving portion 21*c* of the retractable shank 20 is a direction controllable socket wrench.

Figure 17:
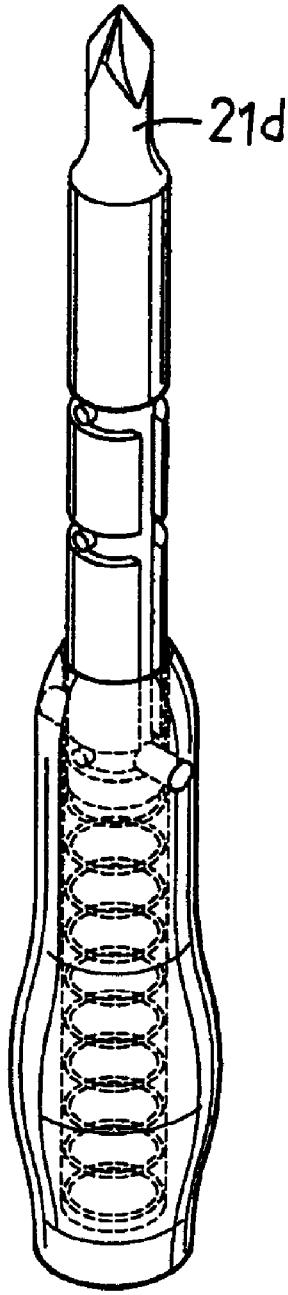
FIG. 17 is a perspective view of a handle tool accordance with another embodiment of the present invention.

Referring to FIG. 17, in accordance with another embodiment of the present invention,. The driving portion 21*d* of the retractable shank 20 is a screwdriver head.

Figure 18:
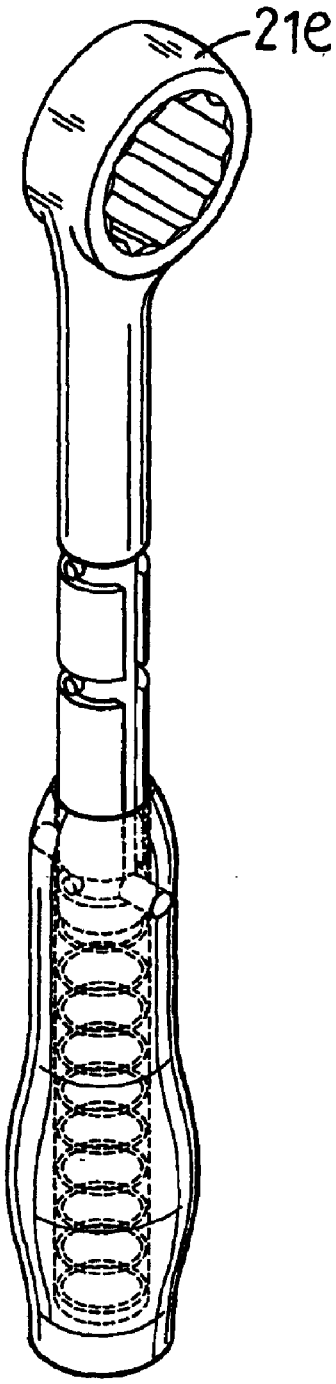
FIG. 18 is a perspective view of a handle tool accordance with another embodiment of the present invention.

Referring to FIG. 18, in accordance with another the present invention of the present invention, the driving portion 21*e* of the retractable shank 20 is a box-ended wrench.

Figure 19:
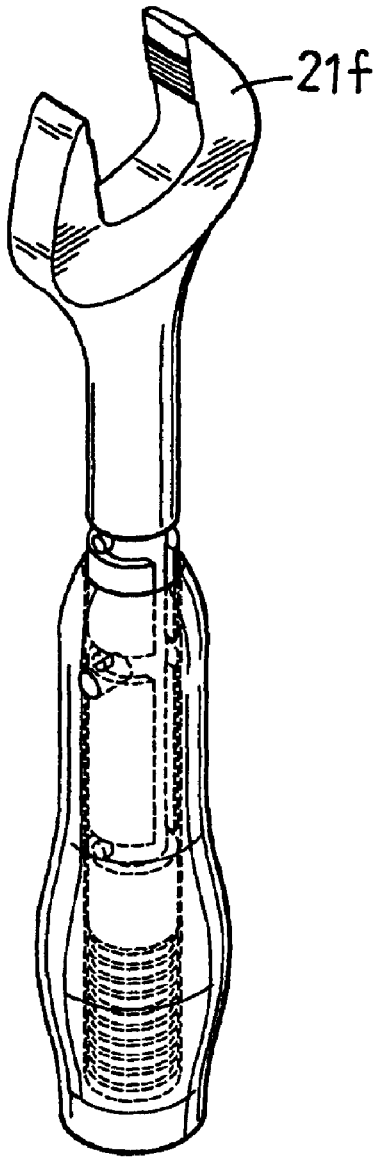
FIG. 19 is a perspective view of a handle tool accordance with another embodiment of the present invention.

Referring to FIG. 19, in accordance with another embodiment of the present invention, the driving portion 21*f* of the retractable shank 20 is an open-ended wrench.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A hand tool comprising:

a retractable shank including a rod assembly having an outer wall formed with an axially arranged slideway and a plurality of radial circumferential limit grooves intersecting the slideway, wherein the sideway is a recess and each groove is a whole circle enclosing a periphery of the retractable shank;

a handle telescopically mounted on the retractable shank; and at least one fixing pin extended through the handle and having a distal end slidably mounted in the slideway of the rod assembly of the retractable shank and slidably positioned in any one of the limit grooves of the rod assembly of the retractable shank;

each of the limit grooves has an end provided with a protruding stop portion for stopping and positioning the fixing pin;

an elastic member mounted between the retractable shank and the handle;

wherein the handle has an inside formed with a receiving chamber for receiving the movable rod of the retractable shank and the elastic member;

wherein the handle has a periphery formed with at least one through hole for receiving the fixing pin;

wherein the through hole of the handle communicates with the receiving chamber of the handle;

wherein each of the limit grooves has a wall formed with a positioning recess extended downward for positioning the fixing pin; and the retractable shank includes a driving portion mounted on one end of the movable rod.

2. The hand tool in accordance with claim 1, wherein the distal end of the fixing pin is extended into the receiving chamber of the handle.

3. The hand tool in accordance with claim 1, wherein the positioning recess is located adjacent to the stop portion.

4. The hand tool in accordance with claim 1, wherein the handle has an end provided with a second driving portion.

5. The hand tool in accordance with claim 1, wherein the driving portion of the retractable shank is selected from one of a ratchet wrench, a socket wrench, a direction controllable socket wrench, a screwdriver head, a box-ended wrench, and an open-ended wrench.

6. A hand tool comprising:

a retractable shank including a rod assembly having an outer wall formed with an axially arranged slideway and a plurality of radial circumferential limit grooves intersecting the slideway; wherein the sideway is a recess and each groove is a whole circle enclosing a periphery of the retractable shank;

a handle telescopically mounted on the retractable shank; and at least one fixing pin extended through the handle and having a distal end slidably mounted in the slideway of the rod assembly of the retractable shank and slidably positioned in any one of the limit grooves of the rod assembly of the retractable shank;

each of the limit grooves has an end provided with a protruding stop portion for stopping and positioning the fixing pin;

a first magnetic member mounted on a distal end of the movable rod of the retractable shank, and a second magnetic member mounted on a bottom of the handle and having a polarity the same as that of the first magnetic member, so that the first magnetic member is repulsive with the second magnetic member;

wherein the handle has an inside formed with a receiving chamber for receiving the movable rod of the retractable shank and the elastic member;

wherein the handle has a periphery formed with at least one through hole for receiving the fixing pin;

wherein the through hole of the handle communicates with the receiving chamber of the handle;

wherein each of the limit grooves has a wall formed with a positioning recess extended downward for positioning the fixing pin; and the retractable shank includes a driving portion mounted on one end of the movable rod.

7. The hand tool in accordance with claim 6, wherein the distal end of the fixing pin is extended into the receiving chamber of the handle.

8. The hand tool in accordance with claim 6, wherein the positioning recess is located adjacent to the stop portion.

9. The hand tool in accordance with claim 6, wherein the handle has an end provided with a second driving portion.

10. The hand tool in accordance with claim 6, wherein the driving portion of the retractable shank is selected from one of a ratchet wrench, a socket wrench, a direction controllable socket wrench, a screwdriver head, a box-ended wrench, and an open-ended wrench.

* * * * *